US005887428A

United States Patent [19]

Garisto

[11] Patent Number: 5,887,428

[45] Date of Patent: Mar. 30, 1999

[54] GASKET-LESS HEADER FOR INTERNAL COMBUSTION ENGINES

[76] Inventor: Anthony Garisto, 707 Walnut Ave., Burlingame, Calif. 94010

[21] Appl. No.: 835,007

[22] Filed: Apr. 7, 1997

[51] Int. Cl.[6] ..... F01N 7/00; B23K 9/04; H01R 43/00

[52] U.S. Cl. ..... 60/323; 29/890.08; 219/76.1; 228/125

[58] Field of Search ..... 60/313, 323; 29/890.08; 219/59.1, 61.13, 76.1; 228/125

[56] References Cited

U.S. PATENT DOCUMENTS 3,716,992 2/1973 Stahl ..... 60/323
4,373,329 2/1983 Martini ..... 60/323 X
4,500,030 2/1985 Gerber et al. ..... 29/890.043 X
4,796,426 1/1989 Feuling ..... 60/323 X

*Primary Examiner*—John E. Ryznic

[57] ABSTRACT

By equipping a header wherein hollow pipes are welded to a rectangular plate used to mount the header with spaced apart extensions of the welds joining the pipes to the plate located on opposite sides of the bolt holes formed in the plate to mount it on an engine, wherein all the welds are ground flat so that the flattened surfaces of the extensions and the welded ends of the pipes lie in a common plane, it is thereafter possible to connect (bolt) the header to the engine's cylinder head employing bolts without the necessity of gaskets.

6 Claims, 4 Drawing Sheets

GASKET-LESS HEADER FOR INTERNAL COMBUSTION ENGINES

BACKGROUND OF THE INVENTION

In the general construction of automobile engines, manifolds are connected to the engine's cylinder head with bolts. Usually gaskets are placed between these manifolds and the head so that leakage will not occur when the manifolds are secured to the head with the bolts and the engine operated.

Traditionally there are two manifolds, one being an intake manifold which includes porting for the flow of air and fuel to the combustion chambers of the engine. The other manifold is the exhaust manifold through which the hot combustion products are vented from the engine. In the more conventional engines the exhaust gases are ported from the cylinders through cylinder heads to the exhaust manifold. Often the exhaust manifolds are constructed of cast iron with multiple ports along one side or face which mate or connect to the outlets in the head along with an internal channel therein communicating with all the ports and a common exhaust outlet. Thus the exhaust gases from the engine pass into the individual ports of the exhaust manifold, and then via the channel in the manifold to the outlet to which an exhaust pipe is connected leading to a muffler and thence to a tail pipe. This invention relates to headers which replace such exhaust manifolds.

Exhaust headers are purchased by car enthusiasts to replace the conventional exhaust manifolds for internal combustion engines, for a number of reasons, not the least of which is to reduce the back pressures thereby increasing horse power output and efficiency of the engine. Typically such headers include multiple pipes one of which pipes connect to one of the outlets on the engine's cylinder head with their opposite ends joined in a plenum chamber formed between the distal ends or opposite ends of the pipes and the exhaust outlet that connects to the exhaust pipe.

Various manufacturers make custom headers, but not the car manufacturers; thus, these non-stock products are not uniform and often gaskets must be special ordered when such headers are mounted on engines for which they are designed. As the headers are light weight, that is much lighter than the cast headers, gaskets are usually necessary due to the mechanical distortion caused by the bolt tensions, thermal distortion and dynamic distortion from the effects of both acting together.

One of the objects of the current invention is the provision of custom headers which overcomes the need for gaskets between the cylinder head and the header.

Another object of the invention is the provision of a custom header which is less prone to leakage after it is installed.

SUMMARY OF THE INVENTION

A novel header comprises a rectangular header plate having a plurality of port apertures and bolt apertures formed therein with a plurality of individual cylinder pipes, each pipe with one end mounted in one of the port apertures and welded therein with a circular bead with two generally parallel extensions projecting from each circular bead on each side thereof so that a pair of the extensions are located on opposite sides of the bolt apertures adjacent to each port aperture, a plenum chamber connecting the opposite ends of the plurality of pipes in a common chamber and an outlet port in the plenum chamber.

DESCRIPTION OF THE DRAWINGS

This invention will be better understood while reading the current specification by referring the attached drawings wherein.

DESCRIPTION OF A PREFERRED EMBODIMENT

Figure 1:
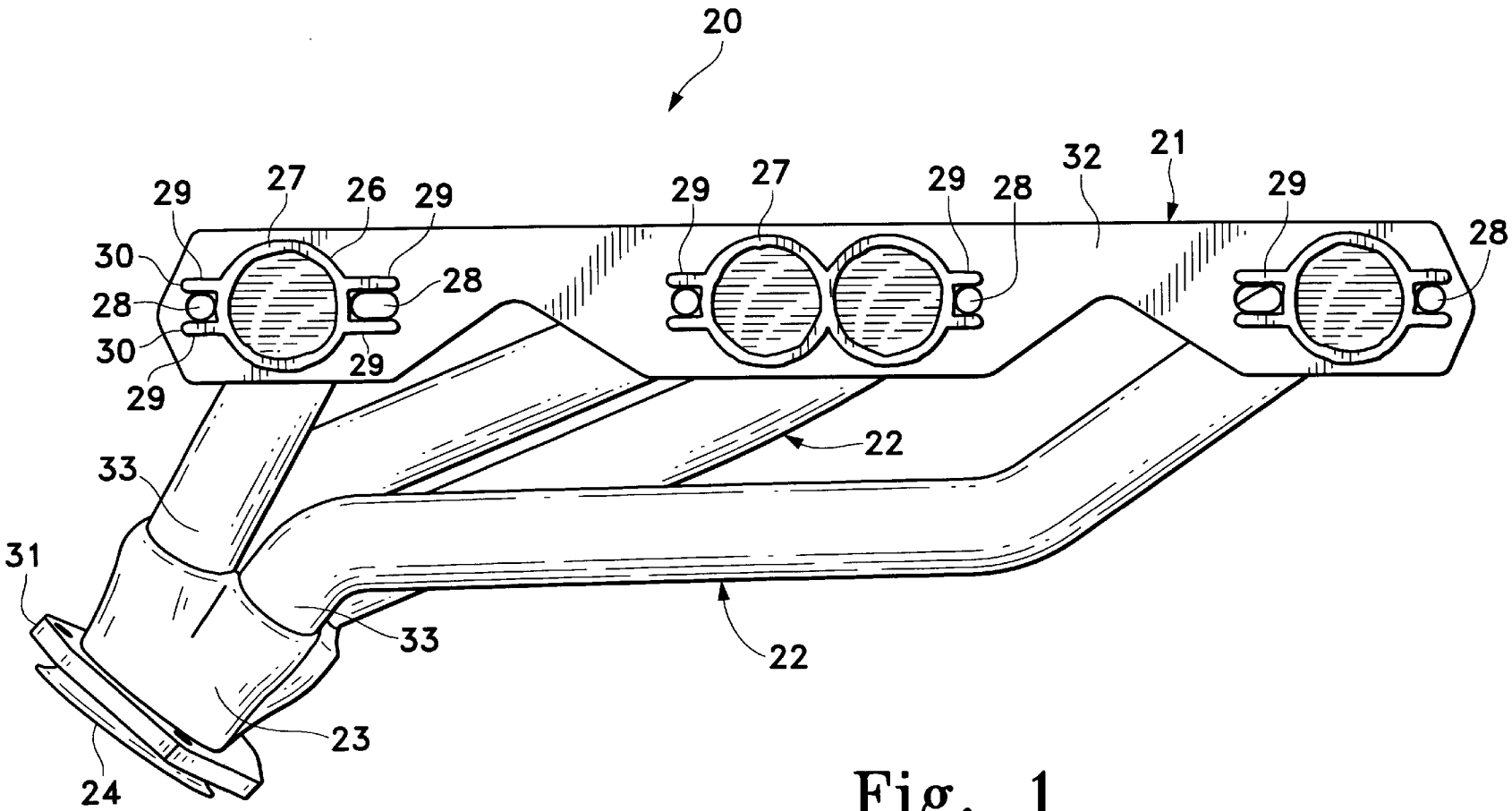
FIG. 1 is an elevation of the novel header illustrating the mounting face thereof which mounts against the engine's cylinder head.

Referring to FIG. 1, with novel header 20 shown in perspective, it can be seen it is constructed of a rectangular mounting plate 21, a plurality of cylinder pipes 22, each with one end mounted in the plate with the opposite ends of the pipes merging in a plenum 23 that has an exhaust outlet 24. The mounting plate is ported with port apertures 25 so that the ends 26 of the cylinder pipes can pass this plate. Once the ends of the pipes have been passed though the plate, they are welded to the plate with a bead 27 that is formed around the entire circumference of each pipe.

Figure 5:
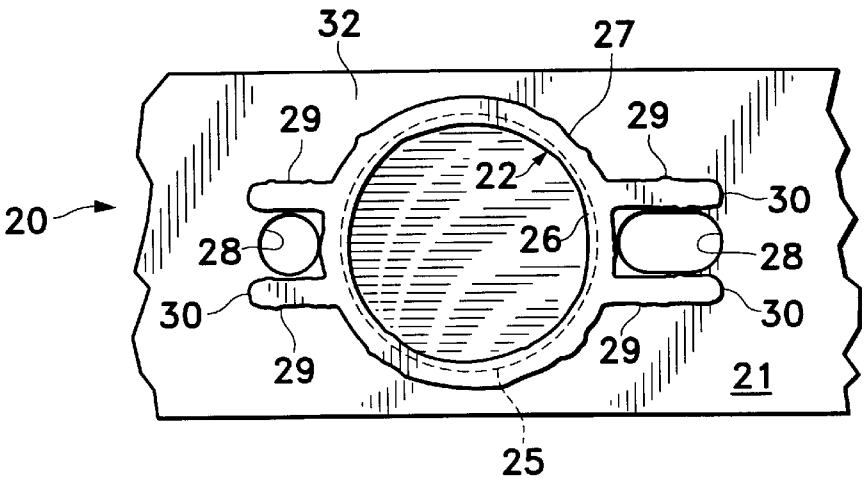
FIG. 5 is an enlarged view of one of the connections of a pipe in the header plate.

As can be seen in the drawings, particularly FIG. 5, figures, the plate 21 has a pair of bolt apertures or holes 28 on opposite sides of each pipe aperture or port 25 though which the bolts or studs can pass to attach the plate to the cylinder head. According to this invention there are two extensions 29 of the circular bead, which are generally parallel, with one extension located on each side of each bolt hole 28, as illustrated. In this construction the extensions are not joined at their distal ends 30 and extend far enough that they extend beyond the associated bolt hole, as best illustrated in FIG. 5.

It can be appreciated that cylinder pipes 22 are formed carefully to provide desired curvature between the plate 21 and the plenum 23 for the least restriction of the flow of the exhaust gases from the header to the plenum. Further these pipes may be "tuned" by controlling the length of each, that is constructed with such lengths that the exhaust gases from the prior firing cylinder may create a negative pressure as to the next cylinder firing thereby assisting in scavenging exhaust gases from the subject cylinder. In general the plenum is merely a connecting chamber for the several pipes and provides a mechanical support for the flange 31 for the exhaust outlet 24 for connecting the plenum to the exhaust pipe (not shown) which connects with the muffler (not shown).

Once the circular beads, along with the two extension 29 on each side of each pipe aperture (a total of four extensions associated with each pipe) are completed, the face or mounting side 32 of the plate 21 is milled so that all the beads and all the extensions are ground to planner surfaces which lie in a single plane. Assuming the distal ends 33 of the cylinder pipes 22 have been previously secured in the plenum 23, the milling step completes the novel header. It must be appreciated if the header is annealed to relieve stresses in this assembly, such annealing is accomplished before the beads and extensions are milled or ground flat.

Once the header 20 is completed it can be mounted on the cylinder head for which is was manufactured, that is the holes 28 are aligned with the studs in the cylinder head 34 (see FIG. 2) and the port apertures 25 align with the exhaust ports in the head as it is common to have a flat milled surface 35 on the face the head where the normal manifold mounts. Thus the novel header has its milled surfaces mounted against this surface and then is secured with bolts or studs 36. However it is important for the milled surface on the head to be cleaned of all residue from old gaskets and the like before the novel header is assembled thereon.

Figure 2:
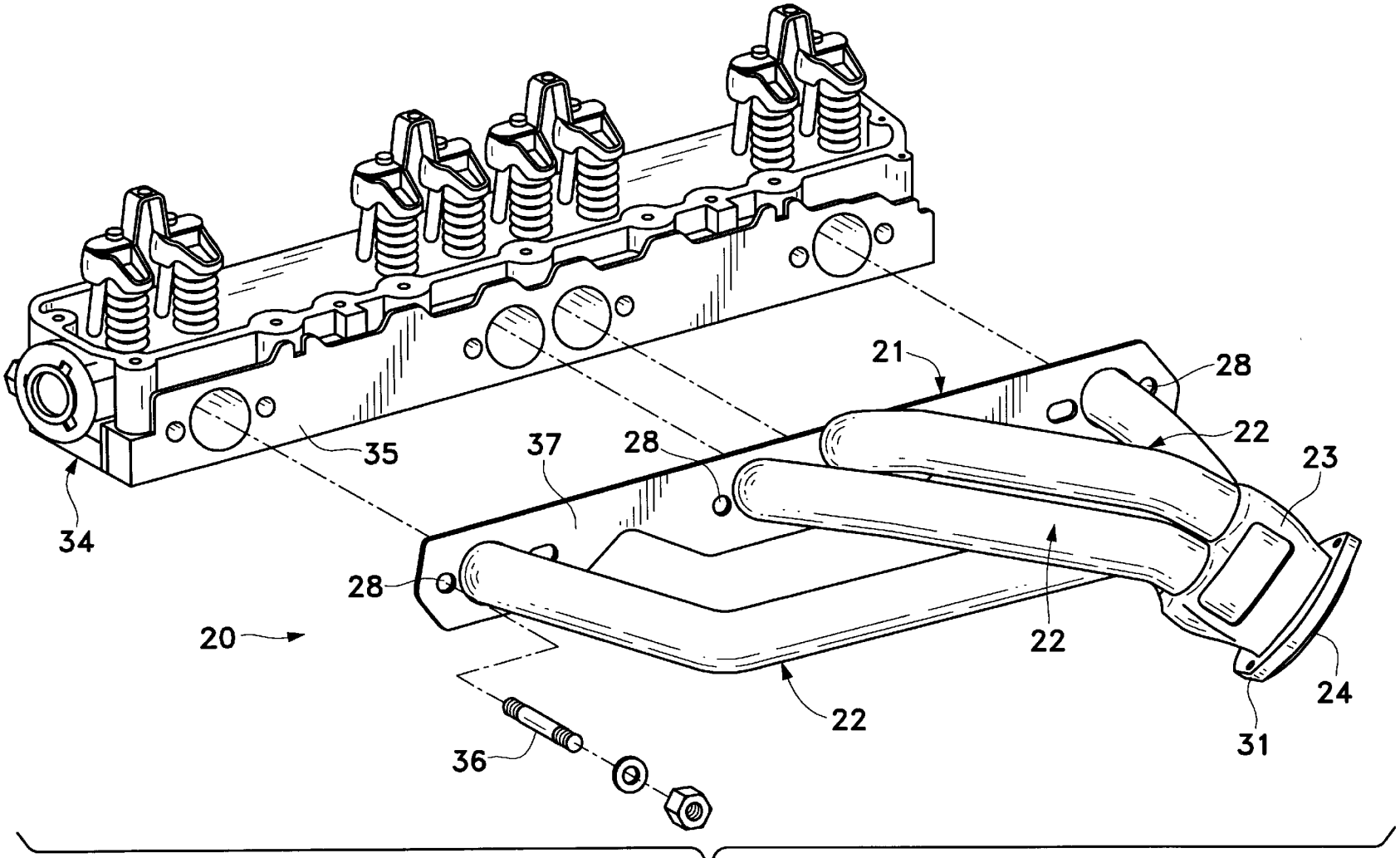
FIG. 2 is a perspective of a cylinder head and the novel header in an exploded view.
Figure 3:
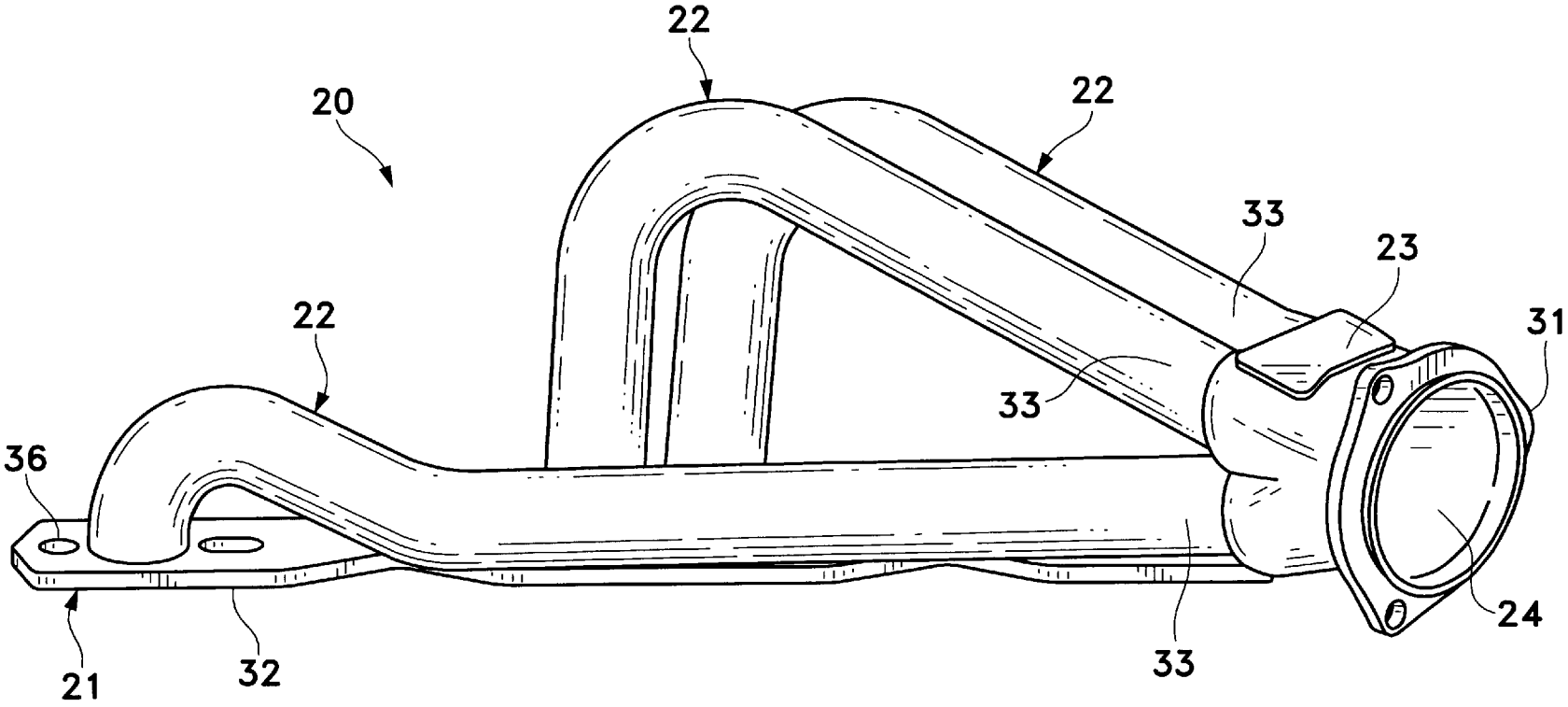
FIG. 3 is a bottom view of the novel header.
Figure 4:
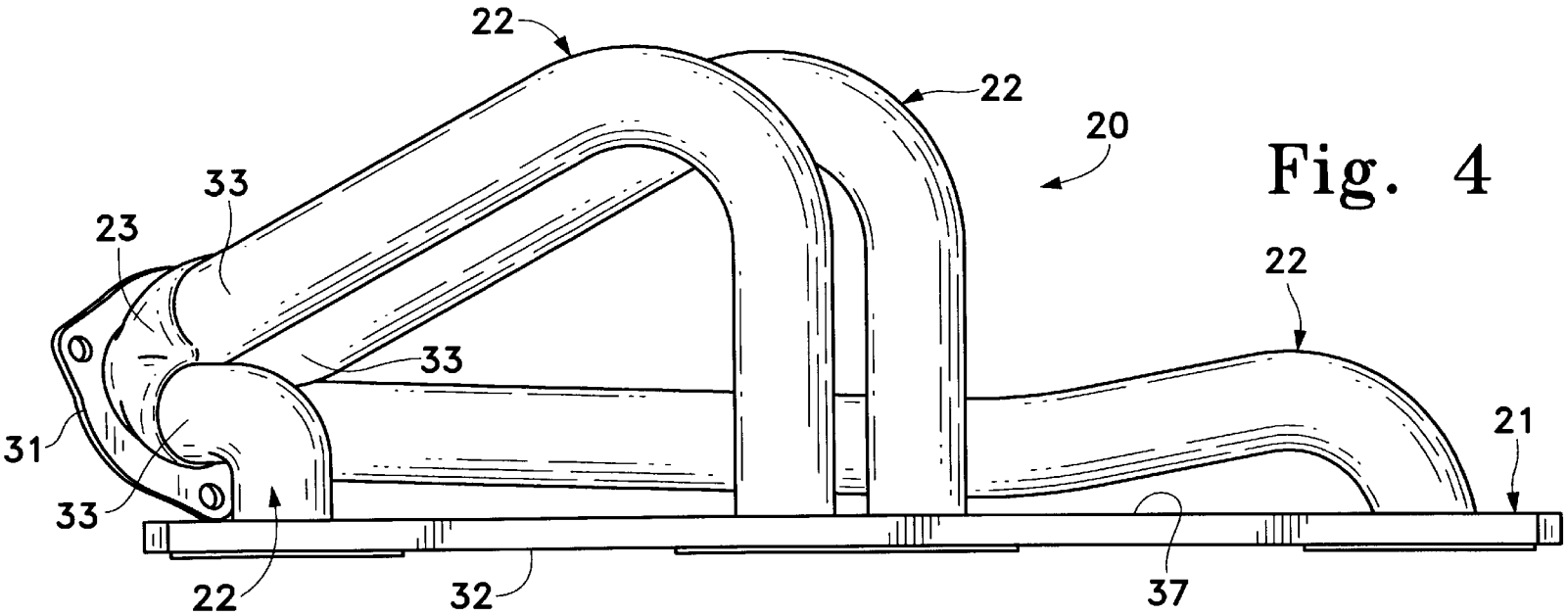
FIG. 4 is top view of the novel header.

The header 20 made according to this invention, mounts against the milled surface 35 of the cylinder head without any gasket. Washers and nuts are assembled on the ends of the studs 36 extending from the cylinder head and passing through the header plate 21 which are tightened with a torque of 12 to 14 foot pounds of torque in a typical installation, as shown in FIG. 2 in an exploded view.

The extensions 29 on each side of the bolt holes 28 stabilize the header plate 20 and prevent it from distorting due to the mechanical forces induced by tightening nuts on the studs 37 against the outside 37 of the header plate. Also since the circular bead and the extensions are formed by the same welds they react uniformly under both heat and pressure distortion whereby once tightened against the cylinder block, the header will not leak. More importantly each pipe is connected as a unit which acts almost like a separate connection, as the mounting plate allows some flex so that each pipe connection will properly align to make a tight seal for each ports. It is this flex in plate 21 in prior art type headers which has often led to exhaust gas leaks, even with gaskets.

Having described my invention by way of illustration and not by way of limitation:

I claim:

1. A novel exhaust header which requires no gasket comprising:

a rectangular header plate having a plurality of port apertures and bolt apertures formed therein;

a plurality of individual cylinder pipes, each pipe having one end mounted in one of said port apertures in said header plate and welded therein with a circular bead having two generally parallel extensions projecting on each side thereof so that a pair of extensions are located on opposite sides of said bolt apertures adjacent to said port aperture with said beads and pipe ends milled so that the resulting milled surfaces lie in a common plane; and a plenum means operably connecting the opposite ends of said pipes in a common chamber, said plenum means having an exhaust outlet therein.

2. The exhaust header defined in claim 1 wherein the extensions on opposite sides of the bolt apertures extend beyond the periphery of their associated aperture whereby said aperture is between said extensions.

3. The exhaust header defined in claim 1 wherein the plenum means is a chamber ported to receive the ends of the cylinder pipes not joined to the rectangular plate and said chamber includes a flange surrounding its outlet for connecting a downstream exhaust system thereto.

4. The exhaust system defined in claim 1 wherein at least two of the cylinder pipes are connected with welds between two bolt apertures whereby the same extensions are operable to stabilize said two pipes joined to the rectangular plate when the header is bolted to a cylinder head.

5. A method of making an exhaust header which can be assembled to the a cylinder head without gaskets comprising the steps of:

forming in a rectangular metal plate port apertures with bolt apertures formed adjacent to each port aperture;

joining one distal end of a cylinder pipe in each of said port apertures with a circular weld and extending said weld on each side of the associated weld for said cylinder pipe so that generally parallel extensions thereof lie on each side of said adjacent bolt apertures, and milling all of said welds so that all the resulting flatten surfaces lie in a common plane.

6. The method defined in claim 5 which includes the step of joining the distal ends of the cylinder pipes not welded to the rectangular plate to a common chamber and forming a outlet in said chamber.

* * * * *